US010765288B2

(12) United States Patent
Jeong et al.

(10) Patent No.: US 10,765,288 B2
(45) Date of Patent: Sep. 8, 2020

(54) VACUUM CLEANER

(71) Applicant: Samsung Electronics Co., Ltd., Suwon-si, Gyeonggi-do (KR)

(72) Inventors: Jae Youl Jeong, Suwon-si (KR); Dong Wook Kim, Suwon-si (KR); Sung Jin Park, Suwon-si (KR); Sin-Ae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 181 days.

(21) Appl. No.: 15/913,560

(22) Filed: Mar. 6, 2018

(65) Prior Publication Data

US 2018/0249878 A1 Sep. 6, 2018

(30) Foreign Application Priority Data

Mar. 6, 2017 (KR) ..... 10-2017-0028123

(51) Int. Cl.

| | |
|---|---|
| ***A47L 11/40*** | (2006.01) |
| ***A47L 9/00*** | (2006.01) |
| ***A47L 5/28*** | (2006.01) |
| ***A47L 9/28*** | (2006.01) |

(52) U.S. Cl.

CPC ..... *A47L 11/4066* (2013.01); *A47L 5/28* (2013.01); *A47L 9/009* (2013.01); *A47L 9/2852* (2013.01); *A47L 11/40* (2013.01); *A47L 11/4063* (2013.01)

(58) Field of Classification Search

CPC . B62B 1/00; B62B 5/0026; B60L 1/00; A47L 11/4063; A47L 11/4066; A47L 5/28; A47L 9/2852

USPC ..... 15/340.1, 340.2; 180/19.3, 209; 280/43

See application file for complete search history.

(56) References Cited

U.S. PATENT DOCUMENTS

| | | | | |
|---|---|---|---|---|
| 2,950,772 | A * | 8/1960 | Dostal | A47L 5/30 180/6.66 |
| 3,220,043 | A * | 11/1965 | Lampe | A47L 5/34 15/340.2 |
| 4,766,640 | A | 8/1988 | Martin et al. | |
| 5,335,740 | A | 8/1994 | Meyer et al. | |
| 5,974,622 | A | 11/1999 | Louis et al. | |

(Continued)

FOREIGN PATENT DOCUMENTS

| | | |
|---|---|---|
| KR | 10-1997-0003572 B1 | 3/1997 |
| KR | 10-2003-0072414 A | 9/2003 |

(Continued)

OTHER PUBLICATIONS

European Search Report dated Jun. 14, 2018 in connection with European Patent Application No. 18 15 9465.

(Continued)

*Primary Examiner* — Bryan R Muller

(57) ABSTRACT

Disclosed herein are a vacuum cleaner including: a base including a suction opening; a main frame including a dust collecting apparatus configured to remove dust from air sucked through the suction opening; and a wheel assembly including a forward wheel and a reverse wheel, and rotatably coupled with the base, wherein when the main frame slides with respect to the base, any one of the forward wheel and the reverse wheel contacts a floor. Therefore, the vacuum cleaner may understand a user's intention without adding a senor and a control circuit, and travel actively according to the user's intention.

16 Claims, 13 Drawing Sheets

(56) References Cited

U.S. PATENT DOCUMENTS

| | | | | |
|---|---|---|---|---|
| 6,085,382 | A * | 7/2000 | Bobrosky | A47L 5/28 15/326 |
| 7,150,068 | B1 | 12/2006 | Ragner | |
| 2003/0163888 | A1 | 9/2003 | Joo et al. | |
| 2004/0205915 | A1 | 10/2004 | Sin et al. | |
| 2006/0156505 | A1 | 7/2006 | Kim et al. | |
| 2007/0061997 | A1 * | 3/2007 | Sano | A47L 5/362 15/340.2 |

FOREIGN PATENT DOCUMENTS

| | | | |
|---|---|---|---|
| KR | 10-0602226 | B1 | 7/2006 |
| KR | 10-2015-0053411 | A | 5/2015 |
| WO | 95/28869 | A1 | 11/1995 |

OTHER PUBLICATIONS

International Search Report dated Aug. 1, 2018 in connection with International Patent Application No. PCT/KR2018/002634.

* cited by examiner

VACUUM CLEANER

CROSS-REFERENCE TO RELATED APPLICATION AND CLAIM OF PRIORITY

This application is related to and claims the benefit of Korean Patent Application No. 10-2017-0028123, filed on Mar. 6, 2017, the disclosure of which is incorporated by reference herein in its entirety.

TECHNICAL FIELD

The present disclosure relates to a vacuum cleaner that travels actively according to a user's intention.

BACKGROUND

A vacuum cleaner is a home appliance including a fan motor to generate a suction force for sucking air from the floor to be cleaned, and a dust collecting apparatus to remove dust from the sucked air to clean the floor. There are various kinds of vacuum cleaners including a canister type, an upright type, a hand type, and a robot type.

An upright type vacuum cleaner includes a main frame having a handle and a dust collecting apparatus, and a base coupled with the main frame and having a suction opening, a brush, and one or more wheels. A user grips the handle of the main frame to clean the floor.

However, many users experience difficulties in operating the upright type vacuum cleaner due to its strong suction force and heavy weight. For this reason, some upright type vacuum cleaners include a driver for driving wheels such that the wheels can travel actively.

However, typical drivers could not accurately identify a user's intention, that is, a direction in which a user intends to clean, which caused cases in which the user is pulled by the vacuum cleaner. In order for a vacuum cleaner to accurately identify a user's intention, the vacuum cleaner needs various sensors and control circuits additionally.

SUMMARY

Therefore, it is an aspect of the present disclosure to provide a vacuum cleaner with improved convenience in operation by reflecting a user's intention to adjust driving speed and a driving direction.

It is another aspect of the present disclosure to provide a cleaner with improved convenience in operation through a simple mechanical structure without including a separate sensor and a control circuit portion.

Additional aspects of the disclosure will be set forth in part in the description which follows and, in part, will be obvious from the description, or may be learned by practice of the disclosure.

In accordance with an aspect of the present disclosure, a vacuum cleaner includes a base including a suction opening; a main frame including a dust collecting apparatus configured to remove dust from air sucked through the suction opening; and a wheel assembly including a forward wheel and a reverse wheel, and rotatably coupled with the base, wherein when the main frame slides with respect to the base, any one of the forward wheel or the reverse wheel contacts a floor.

The vacuum cleaner may further include a bracket coupled with the base and the main frame, wherein the bracket may slide with respect to the base together with the main frame.

The bracket may include a rack gear portion configured to rotate the wheel assembly.

The wheel assembly may include a wheel housing in which the forward wheel and the reverse wheel are installed, and the wheel housing may include a pinion gear portion engaged with the rack gear portion.

The vacuum cleaner may further include a link configured to connect the bracket to the wheel assembly, and forming a slider crank mechanism configured to convert sliding of the bracket into rotation of the wheel assembly.

The vacuum cleaner may further include a driving motor configured to generate power for driving the forward wheel and the reverse wheel; and a power transmission mechanism configured to transmit the power from the driving motor to the forward wheel and the reverse wheel.

The power transmission mechanism may include a base gear assembly disposed in the base, a wheel gear assembly disposed in the wheel housing, and a connection shaft connecting the base gear assembly to the wheel gear assembly.

The wheel gear assembly may be configured to rotate on the connection shaft.

The wheel gear assembly may include a connection gear configured to rotate on the connection shaft, at least one forward gear disposed between the connection gear and the forward wheel, and at least one reverse gear disposed between the connection gear and the reverse wheel.

The vacuum cleaner may further include a one-way clutch disposed between the at least one forward gear and the forward wheel; and a second one-way clutch disposed between the at least one reverse gear and the reverse wheel.

The forward wheel and the reverse wheel may be configured to rotate simultaneously.

The forward wheel and the reverse wheel may be configured to rotate in opposite directions.

The forward wheel and the reverse wheel may be configured to rotate at the same speed.

The wheel assembly may include an idle wheel contacting the floor when none of the forward wheel and the reverse wheel contacts the floor.

In accordance with another aspect of the present disclosure, a vacuum cleaner includes a base including a suction opening; a main frame including a dust collecting apparatus configured to remove dust from air sucked through the suction opening; a bracket coupled with the base and the main frame, wherein the bracket slides with respect to the base together with the main frame; and a wheel assembly including a wheel housing and a wheel installed in the wheel housing, and rotatably coupled with the base, wherein when the main frame and the bracket slide with respect to the base, the wheel contacts or does not contact a floor.

The bracket may include a rack gear portion configured to rotate the wheel assembly, and wherein the wheel housing comprises a pinion gear portion engaged with the rack gear portion.

The wheel assembly may include a left wheel assembly disposed in a left portion of the base, and a right wheel assembly disposed in a right portion of the base.

The vacuum cleaner may further include a driving motor configured to generate power for driving a wheel of the left wheel assembly and a wheel of the right wheel assembly; and a power transmission mechanism configured to transfer power from the driving motor to the wheel of the left wheel assembly and the wheel of the right wheel assembly.

The power transmission mechanism may include a differential gear apparatus configured to transfer power to the wheel of the left wheel assembly and the wheel of the right wheel assembly, differentially, according to loads applied from the driving motor to the wheel of the left wheel assembly and the wheel of the right wheel assembly.

In accordance with another aspect of the present disclosure, a vacuum cleaner includes a base including a suction opening; a main frame including a dust collecting apparatus configured to remove dust from air sucked through the suction opening; and a left wheel assembly and a right wheel assembly each including a forward wheel and a reverse wheel, and rotatably coupled with left and right portions of the base, wherein when the main frame is pushed, the left wheel assembly and the right wheel assembly rotate in a first direction so that a forward wheel of the left wheel assembly and a forward wheel of the right wheel assembly contact a floor, and wherein when the main frame is pulled, the left wheel assembly and the right wheel assembly rotate in a second direction that is opposite to the first direction so that a reverse wheel of the left wheel assembly and a reverse wheel of the right wheel assembly contact the floor.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

FIGS. 1 through 13, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present disclosure are embodiments of the present disclosure, and thus it is to be understood that various equivalents or modified examples, that may replace the embodiments described in the present specification, are possible.

Hereinafter, the embodiments of the present disclosure will be described in detail with reference to the accompanying drawings.

Figure 1:
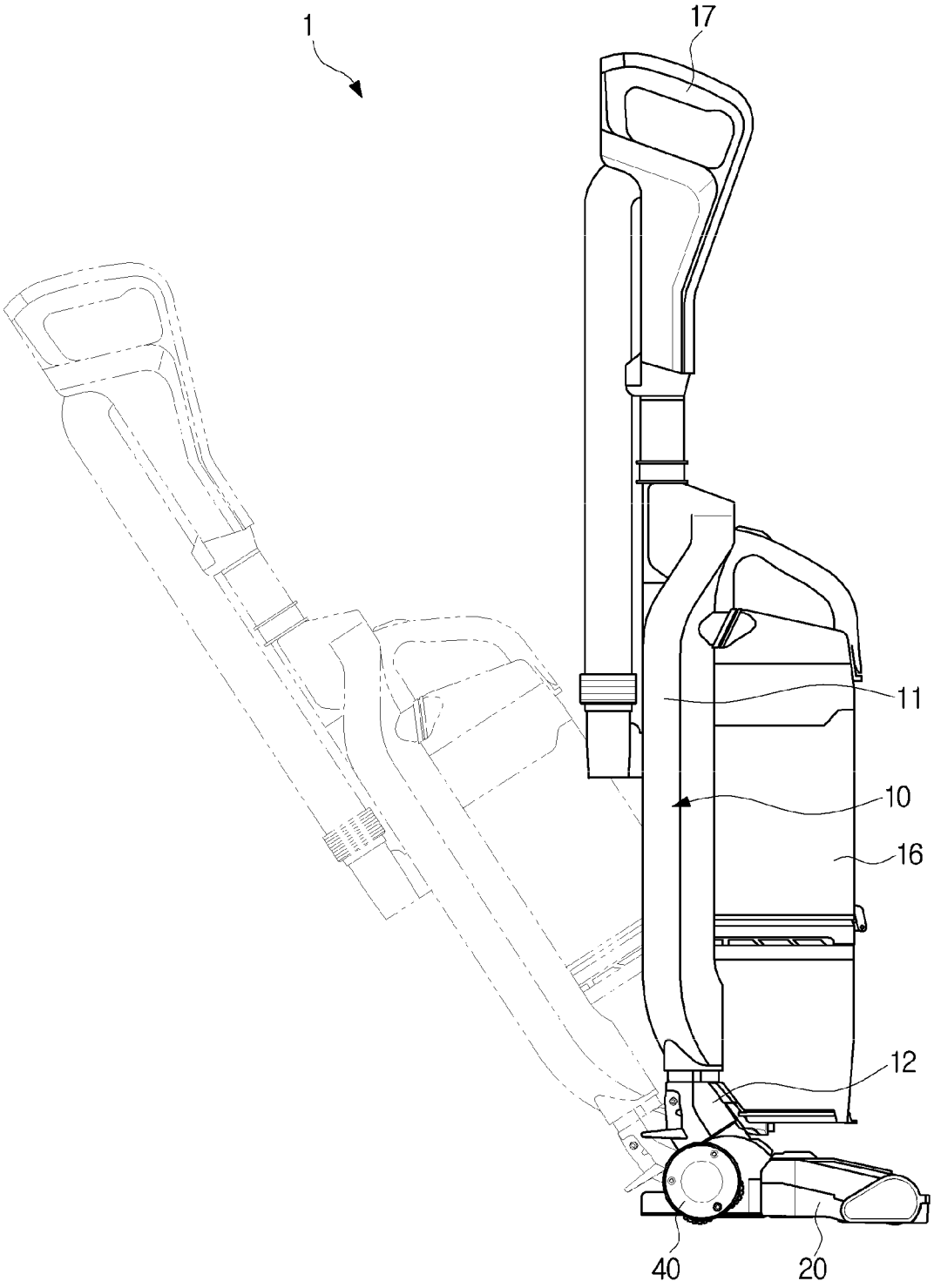
FIG. 1 illustrates a vacuum cleaner according to an embodiment of the present disclosure.
Figure 2:
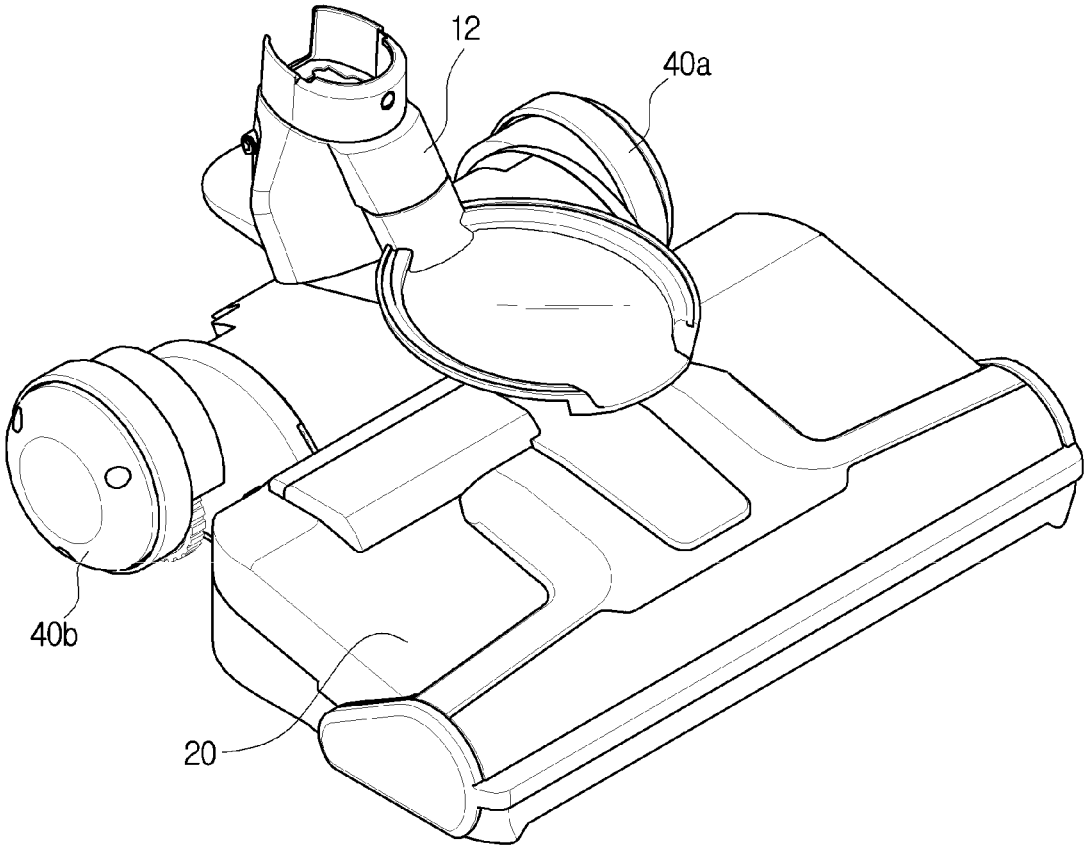
FIG. 2 illustrates a base portion and a wheel assembly of the vacuum cleaner of FIG. 1.
Figure 3:
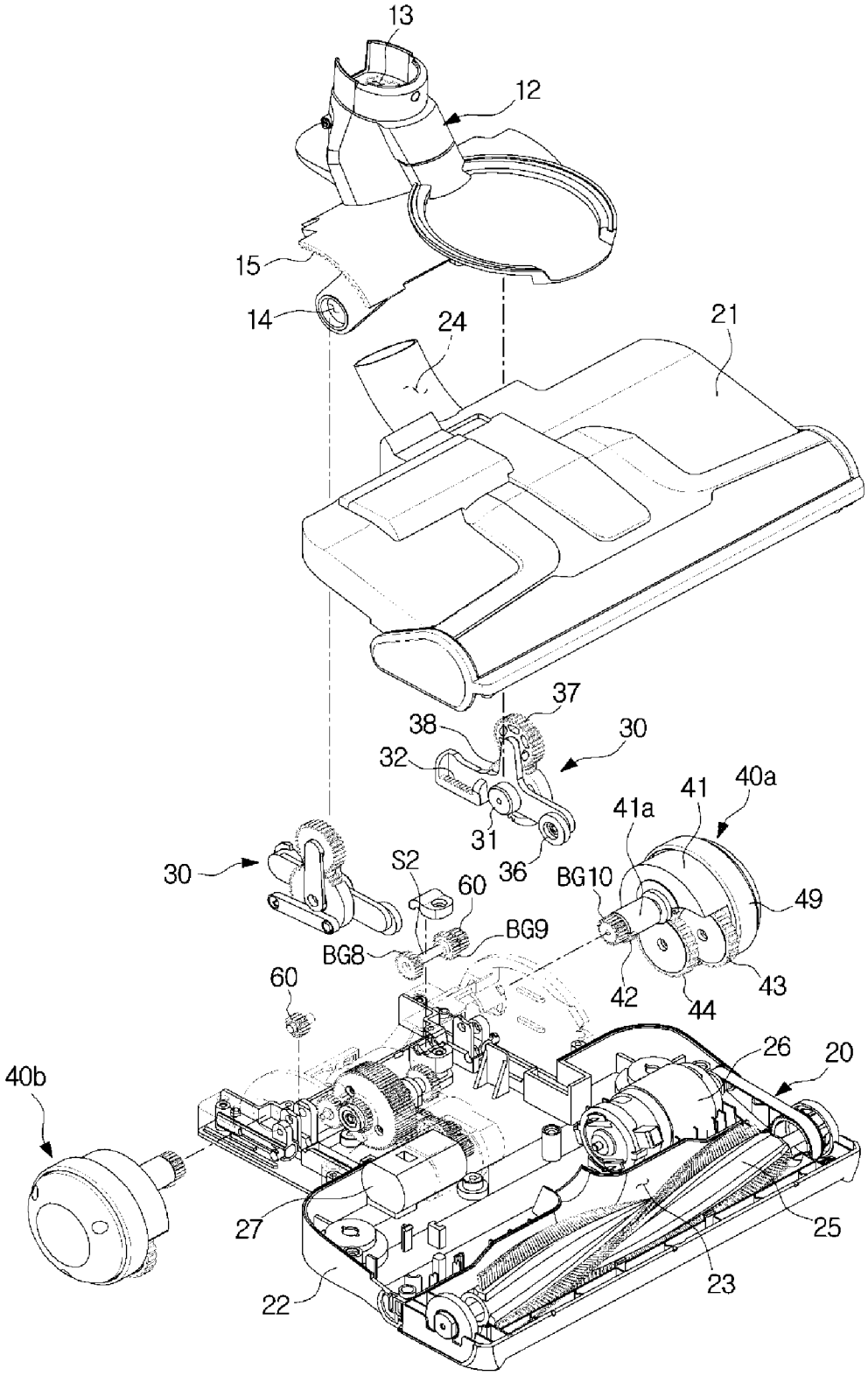
FIG. 3 is an exploded perspective view illustrating an internal structure of the base portion of the vacuum cleaner of FIG. 1.
Figure 4:
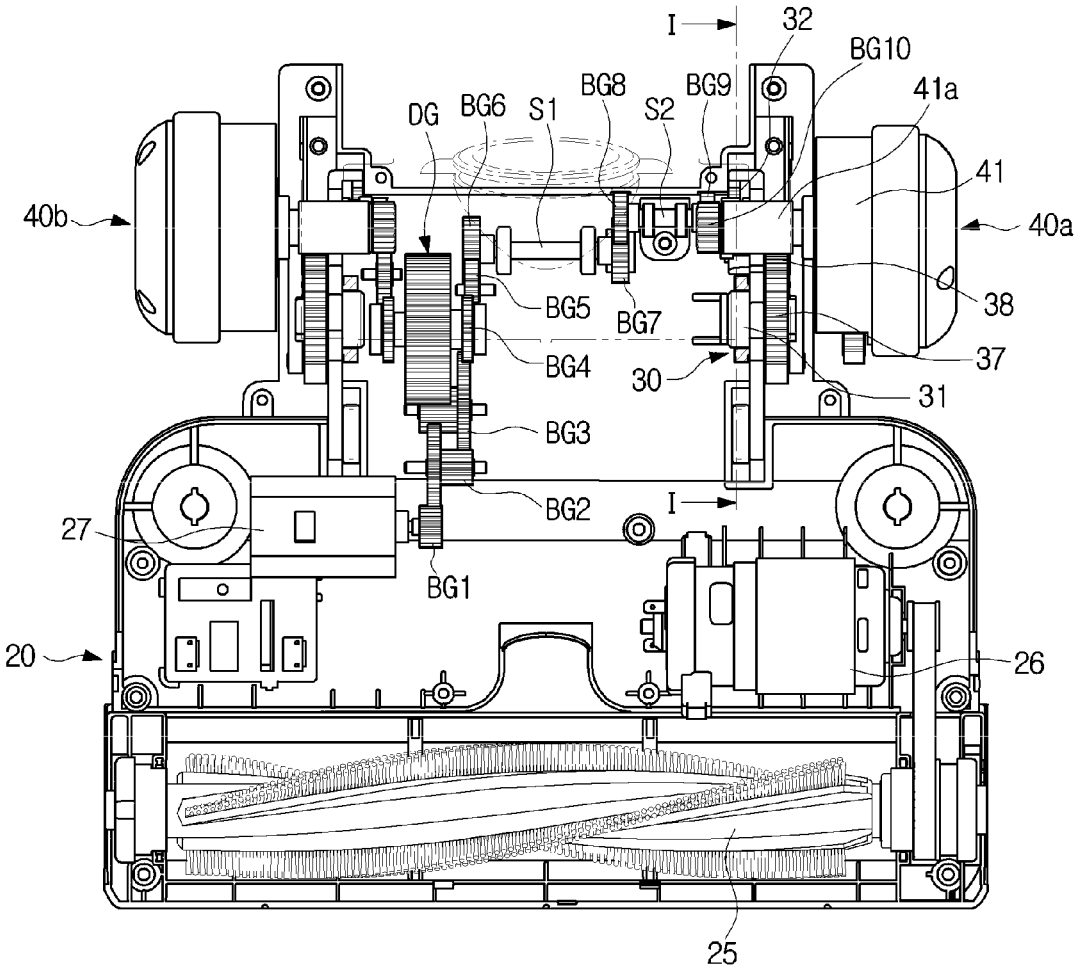
FIG. 4 is a top view illustrating the internal structure of the base portion of the vacuum cleaner of FIG. 1.
Figure 5:
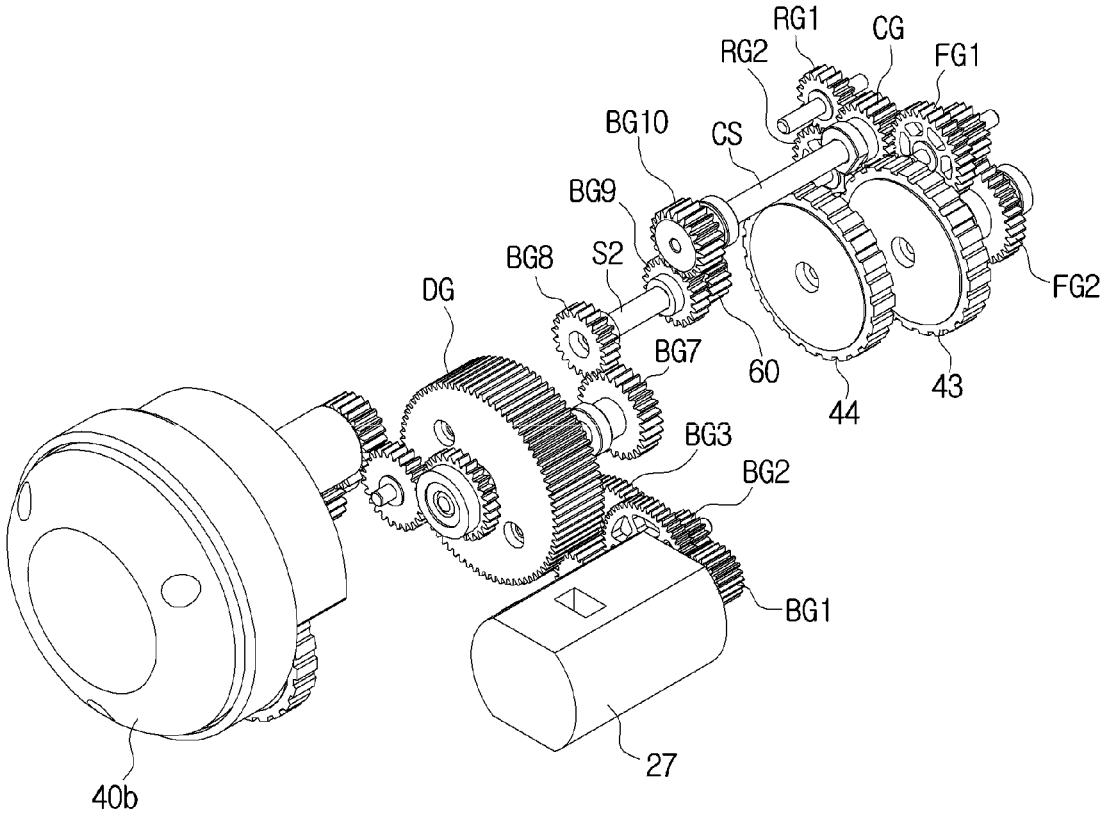
FIG. 5 illustrates a power transmission mechanism of the vacuum cleaner of FIG. 1.
Figure 6:
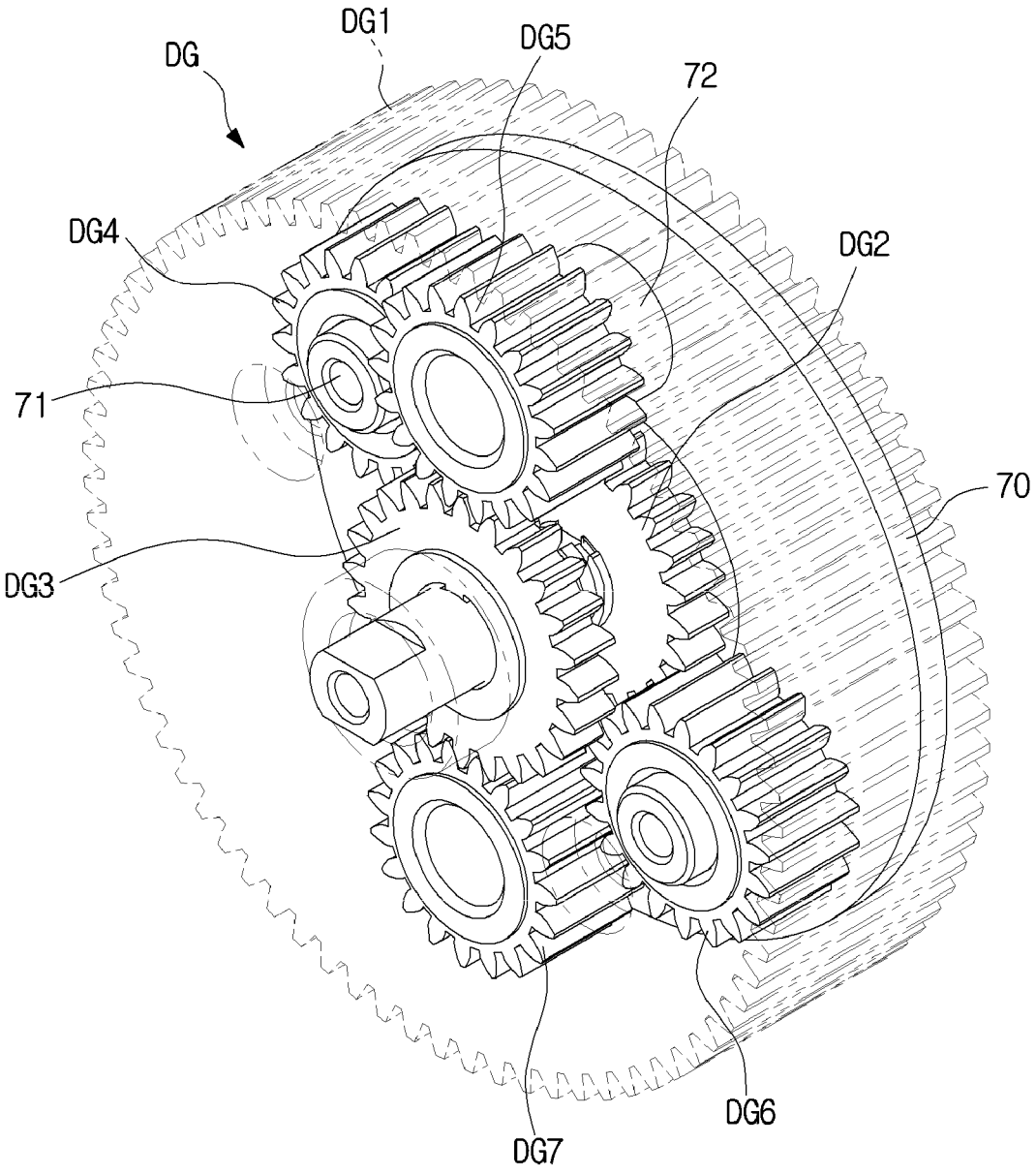
FIG. 6 illustrates a differential gear apparatus of the vacuum cleaner of FIG. 1.
Figure 7:
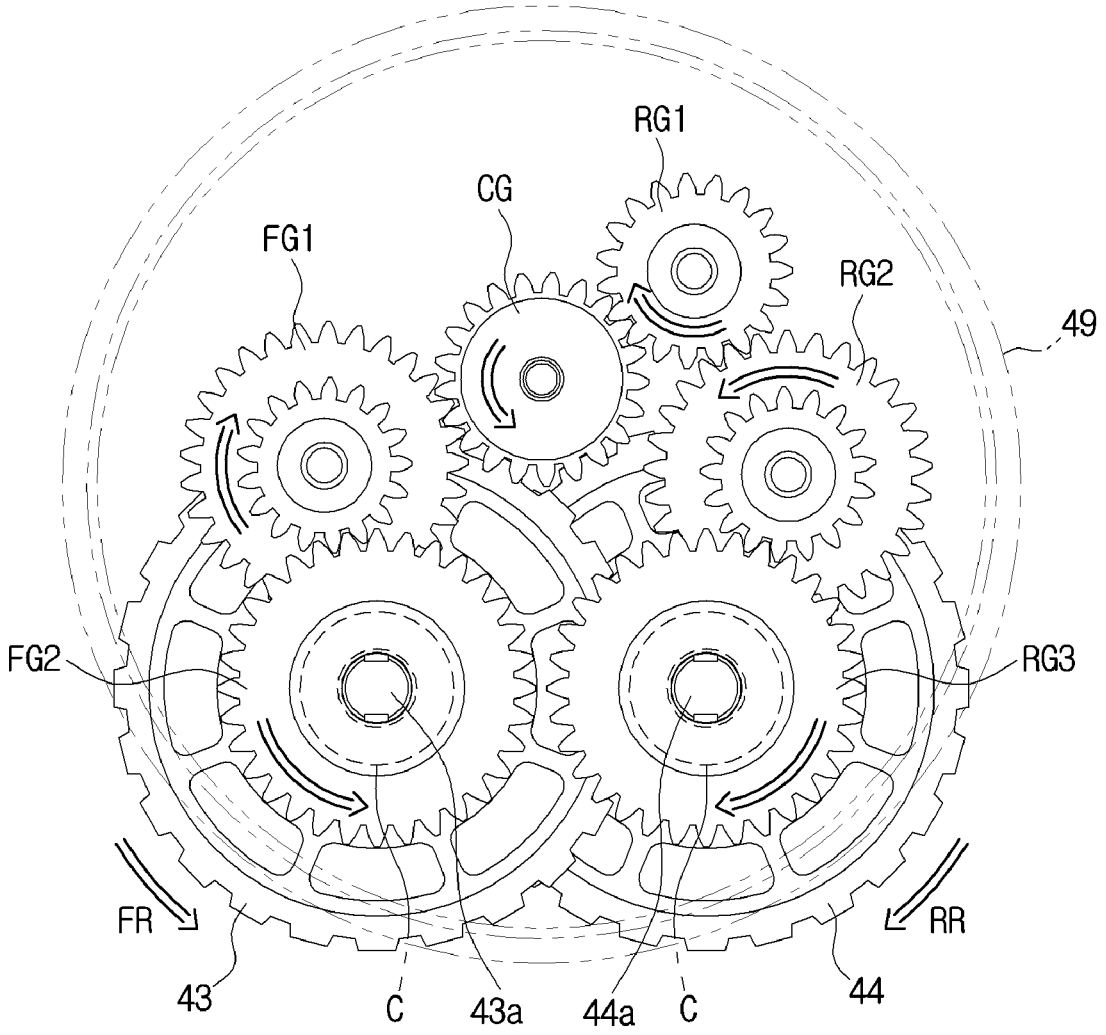
FIG. 7 illustrates a wheel gear assembly of a wheel assembly of the vacuum cleaner of FIG. 1.

FIG. 1 illustrates a vacuum cleaner according to an embodiment of the present disclosure. FIG. 2 illustrates a base portion and a wheel assembly of the vacuum cleaner of FIG. 1. FIG. 3 is an exploded perspective view illustrating an internal structure of the base portion of the vacuum cleaner of FIG. 1. FIG. 4 is a top view illustrating the internal structure of the base portion of the vacuum cleaner of FIG. 1. FIG. 5 illustrates a power transmission mechanism of the vacuum cleaner of FIG. 1. FIG. 6 illustrates a differential gear apparatus of the vacuum cleaner of FIG. 1. FIG. 7 illustrates a wheel gear assembly of a wheel assembly of the vacuum cleaner of FIG. 1.

Referring to FIGS. 1 to 7, a vacuum cleaner 1 may include a base 20 including a suction opening 23 configured to suck air from a floor to be cleaned, a main frame 10 including a suction fan (not shown) configured to generate a suction force and a dust collecting apparatus 16 configured to remove dust from the air sucked through the suction opening 23, and a pair of wheel assemblies 40 (that is, a left wheel assembly 40*a* and a right wheel assembly 40*b*) disposed in left and right portions of the base 20.

The base 20 may be formed by assembling an upper base 21 with a lower base 22. In the base 20, a suction flow path 24 may be formed to guide air sucked through the suction opening 23 to the dust collecting apparatus 16.

The suction flow path 24 may communicate with a guide flow path 13 of the main frame 10. Accordingly, air sucked through the suction opening 23 may be guided to the dust collecting apparatus 16 via the suction flow path 24 and the guide flow path 13. The dust collecting apparatus 16 may collect dust from the air, and then discharge the air from which the dust has been removed to the outside through a separate outlet (not shown).

A brush 25 may be rotatably installed in the suction opening 23. The brush 25 may be configured to sweep dust from the floor to be cleaned. Dust remaining on the floor may be swept up from the floor by the brush 25, and sucked into the suction opening 23 by a suction force of the suction fan. The brush 25 may rotate by receiving power from a brush driving motor 26.

The dust collecting apparatus 16 may be a dust bag type to filter dust out by passing air through a dust bag, or a cyclone type to separate dust through centrifugation, although the dust collecting apparatus 16 is not limited to these embodiments.

The main frame 10 may be configured with a main frame body 11, and a neck portion 12 disposed below the main frame body 11 to be coupled with the base 20. The neck portion 12 may be rotatably coupled with the base 20. The neck portion 12 may include an operating groove 14 into which an operating protrusion 31 of a bracket 30 is inserted, and a neck tooth portion 15 supported by a support gear 37.

In the main frame body 11, a handle 17 configured to be gripped by a user's hand to move the main frame 10 may be provided. The user may grip the handle 17 to push or pull the main frame 10 or to turn the main frame 10 in a left or right direction.

The wheel assemblies 40 may be disposed in the left and right portions of the base 20. Each of the left and right wheel assemblies 40*a* and 40*b* may include a forward wheel 43 and a reverse wheel 44. That is, the vacuum cleaner 1 according to an embodiment of the present disclosure may include a total of four wheels, that is, the forward wheel 43 and the reverse wheel 44 of the left wheel assembly 40*a* and the forward wheel 43 and the reverse wheel 44 of the right wheel assembly 40*b*.

The forward wheel 43 and the reverse wheel 44 may rotate by receiving power from a driving motor 27 to enable the vacuum cleaner 1 to travel actively. Particularly, the vacuum cleaner 1 according to an embodiment of the present disclosure may understand the user's intention, and move forward/backward or turn according to the user's intention.

The vacuum cleaner 1 may include the bracket 30 coupled with the base 20 in such a way to slide back and forth. In order for the bracket 30 to be coupled with the base 20 in such a way to slide back and forth, a bracket installing portion 28 may be formed in the base 20, wherein the bracket 30 is slidably coupled with the bracket installing portion 28. In a front end and a rear end of the bracket installing portion 28, stopper portions 29*a* and 29*b* (see FIG. 8) may be formed to limit a movement range of the bracket 30.

In some embodiments, the bracket 30 may be further coupled with the main frame 10. More specifically, the bracket 30 may be coupled with the main frame 10 in such a way to translate together with the main frame 10, while relatively rotating with respect to the main frame 10. For this, the bracket 30 may include an operating protrusion 31 inserted into the operating groove 14 of the neck portion 12 of the main frame 10. The operating protrusion 31 may be rotatable in the operating groove 14. When the operating protrusion 31 of the bracket 30 is inserted into and coupled with the operating groove 14 of the neck portion 12, the bracket 30 may translate together with the main frame 10, and rotate with respect to the main frame 10.

The bracket 30 may include support gears 37 and 38 to rotatably support the main frame 10. The support gear 38 may be engaged with the neck tooth portion 15 of the neck portion 12 of the main frame 10 to support a weight of the main frame 10 regardless of an angle of rotation of the main frame 10.

The bracket 30 may include a rack gear portion 32 configured to rotate the wheel assemblies 40. When the main frame 10 slides with respect to the base 20, the rack gear portion 32 of the bracket 30 may slide accordingly, and the sliding of the rack gear portion 32 may be transferred to the wheel assemblies 40 so that the wheel assemblies 40 can rotate.

More specifically, the rack gear portion 32 may be engaged with a middle gear 60, and the middle gear 60 may be engaged with a pinion gear portion 42 of the wheel assemblies 40. The bracket 30 may include a roller 36 to cause the bracket 30 to slide smoothly in the base 20. A pair of brackets 30 may be respectively disposed in the left and right portions of the base 20.

Each wheel assembly 40 may include a wheel housing 41, and the forward wheel 43 and the reverse wheel 44 installed in the wheel housing 41. The wheel housing 41 may include a shaft portion 41*a* protruding toward the base 20. The shaft portion 41*a* may be in the shape of a cylinder, and the pinion gear portion 42 may be formed on an outer circumferential surface of the shaft portion 41*a*. Accordingly, the wheel housing 41 may rotate on the shaft portion 41*a*.

The forward wheel 43 and the reverse wheel 44 may be installed in the wheel housing 41 in such a way to be rotatable on rotation shafts 43*a* and 44*a* (see FIG. 7), respectively. A rotation shaft 43*a* of the forward wheel 43 may be eccentric to a rotation shaft 44*a* of the reverse wheel 44, and the rotation shaft 43*a* of the forward wheel 43 and the rotation shaft 44*a* of the reverse wheel 44 may be eccentric to the shaft portion 41*a* of the wheel housing 41. Accordingly, when the wheel housing 41 rotates on the shaft portion 41*a*, the forward wheel 43 and the reverse wheel 44 may also rotate (revolve) around the shaft portion 41*a*.

When the driving motor 27 operates, the forward wheel 43 and the reverse wheel 44 may rotate (spin) on the corresponding rotation shafts 43*a* and 44*a*. The forward wheel 43 and the reverse wheel 44 may be rotatable in opposite directions. For example, the forward wheel 43 may rotate in a direction of moving the base 20 forward, and the reverse wheel 44 may rotate in a direction of moving the base 20 backward.

As described above, the middle gear 60 may be engaged with the pinion gear portion 42, and the rack gear portion 32 of the bracket 30 may be engaged with the middle gear 60. Accordingly, when the rack gear portion 32 slides, the middle gear 60 may rotate in one direction, and the pinion gear portion 42 may rotate in the opposite direction. As a result, when the main frame 10 is pushed forward or pulled backward, the wheel housing 41 may rotate on the shaft portion 41*a*. When the wheel housing 41 rotates on the shaft portion 41*a*, the forward wheel 43 and the reverse wheel 44 installed in the wheel housing 41 may also rotate on the shaft portion 41*a*.

According to an embodiment of the present disclosure, when the main frame 10 slides with respect to the base 20, any one of the forward wheel 43 and the reverse wheel 44 of each wheel assembly 40 may contact a floor. More specifically, in an initial state, none of the forward wheel 43 and the reverse wheel 44 may contact the floor, and when the main frame 10 slides forward with respect to the base 20, the forward wheel 43 may contact the floor. In contrast, when the main frame 10 slides backward with respect to the base 20, the reverse wheel 44 may contact the floor.

The wheel assembly 40 may include an idle wheel 49 configured to contact the floor when none of the forward wheel 43 and the reverse wheel 44 contacts the floor.

In the current embodiment, the middle gear 60 may be disposed between the rack gear portion 32 of the bracket 30 and the pinion gear portion 42 of the wheel assembly 40. However, in some embodiments the rack gear portion 32 may be directly engaged with the pinion gear portion 42 without the middle gear 60 in between.

The vacuum cleaner 1 may include the driving motor 27, configured to generate power for driving the forward wheel 43 and the reverse wheel 44, and a power transmission mechanism configured to transmit power generated by the driving motor 27 to the forward wheel 43 and the reverse wheel 44.

According to an embodiment of the present disclosure, all of the four wheels: the forward wheel 43 and the reverse wheel 44 of the left wheel assembly 40*a* and the forward wheel 43 and the reverse wheel 44 of the right wheel assembly 40*b*, may receive power from the driving motor 27. According to an embodiment of the present disclosure, the driving motor 27 for providing power to the wheels may be separated from the brush driving motor 26 that is configured to provide power to the brush 25. However, a single motor may supply power to both the wheels and the brush 25.

As the power transmission mechanism, various mechanical elements for transmitting power, such as a gear, a belt, a pulley, and a chain, may be used. In one embodiment, the power transmission mechanism may include a base gear assembly disposed in the base 20, a wheel gear assembly disposed in the wheel housing 41, and a connection shaft CS (see FIG. 5) configured to connect the base gear assembly to the wheel gear assembly.

The base gear assembly may include base gears BG1 to BG3 disposed between the driving motor 27 and a differential gear apparatus DG, and base gears BG4 to BG9 disposed between the differential gear apparatus DG and the connection shaft CS.

The differential gear apparatus DG may distribute power generated by the driving motor 27, and transfer the distributed power to the wheel assemblies 40*a* and 40*b* disposed in the left and right portions of the base 20. As shown in FIG. 6, the differential gear apparatus DG may include a ring gear DG1 connected to a driving side, a plurality of sun gears DG2 and DG3 connected to a passivity side, and a plurality of planetary gears DG4 and DG5 configured to spin and revolve around the plurality of sun gears DG2 and DG3.

The planetary gear DG4 may be engaged with the planetary gear DG5, the planetary gear DG4 may be engaged with the sun gear DG2, and the planetary gear DG5 may be engaged with the sun gear DG3. Accordingly, the sun gear DG2, the sun gear DG3, the planetary gear DG4, and the planetary gear DG5 may be engaged with one another.

The differential gear apparatus DG may include a plurality of additional planetary gears DG6 and DG7 to transfer power more stably. The planetary gears DG6 and DG7 may perform the same function as the planetary gears DG4 and DG5.

The ring gear DG1 may be integrated into a disk 70, and a plurality of rotating shafts 71 and 72 of the plurality of planetary gears DG4 and DG5 may protrude from the disk 70 in such a way to be eccentric to a rotation shaft of the ring gear DG1.

Through the above-described structure, when the driving motor 27 operates and thus the ring gear DG1 rotates, the disk 70 may rotate together with the ring gear DG1, and the plurality of planetary gears DG4 and DG5 connected to the rotating shafts 71 and 72 formed on the disk 70 may revolve around the rotating shaft of the ring gear DG1. Accordingly, the plurality of sun gears DG2 and DG3 may rotate to transfer a rotation force to the plurality of wheel assemblies 40*a* and 40*b*.

When different loads are applied to the plurality of wheel assemblies 40*a* and 40*b*, that is, when a user turns the vacuum cleaner 1 in the left or right direction, different loads may be applied to the plurality of sun gears DG2 and DG3, and accordingly, the plurality of planetary gears DG4 and DG5 may rotate in different directions.

Accordingly, the plurality of sun gears DG2 and DG3 may rotate by different numbers of rotation resulting from adding or subtracting the numbers of rotation of the plurality of planetary gears DG4 and DG5. As a result, the differential gear apparatus DG may transfer power to the forward wheel 43 and reverse wheel 44 of the left wheel assembly 40*a* and the forward wheel 43 and reverse wheel 44 of the right wheel assembly 40*b* differentially, according to loads applied to the left wheel assembly 40*a* and the right wheel assembly 40*b*.

For example, when the user turns the vacuum cleaner 1 in the left direction, a load may be applied to the forward wheel 43 and reverse wheel 44 of the left wheel assembly 40*a*, and accordingly, more power may be transferred to the forward wheel 43 and reverse wheel 44 of the right wheel assembly 40*b* than to the forward wheel 43 and reverse wheel 44 of the left wheel assembly 40*a*. Accordingly, the forward wheel 43 and reverse wheel 44 of the right wheel assembly 40*b* may rotate more than the forward wheel 43 and reverse wheel 44 of the left wheel assembly 40*a*, so that the vacuum cleaner 1 can turn to the left.

In some embodiments, the base gears BG1 to BG3 may be engaged with one another. In some embodiments, the base gears BG4 to BG6 may be engaged with one another. The base gears BG6 and BG7 may be connected to a shaft S1 to rotate together. The base gear BG7 may be engaged with the base gear BG8, and rotate together with the base gear BG8. The base gears BG8 and BG9 may be connected to a shaft S2 to rotate together. The middle gear 60 may be rotatable on the shaft S2.

The connection shaft CS may be disposed in the inside of the shaft portion 41*a* of the wheel housing 41 described above. Accordingly, the wheel assembly 40 may rotate on the connection shaft CS.

The wheel gear assembly may include a connection gear CG coupled with the connection shaft CS to rotate on the connection shaft CS, one or more forward gears FG1 and FG2 disposed between the connection gear CG and the forward wheel 43 in such a way to be engaged with each other, and one or more reverse gears RG1, RG2, and RG3 disposed between the connection gear CG and the reverse wheel 44 in such a way to be engaged with each other.

The number of the forward gears FG1 and FG2 may be different from the number of the reverse gears RG1, RG2, and RG3 so that the forward wheel 43 and the reverse wheel 44 may rotate in different directions. In the current embodiment, two forward gears FG1 and FG2 may be provided so that the forward wheel 43 may rotate in the same direction FR (see FIG. 7) as a rotation direction of the connection gear CG, and three reverse gears RG1, RG2, and RG3 may be provided so that the reverse wheel 44 may rotate in a direction RR (see FIG. 7) that is opposite to a rotation direction of the forward wheel 43. In some embodiments, by adjusting gear ratios of the forward gears FG1 and FG2 and the reverse gears RG1, RG2, and RG3, the forward wheel 43 and the reverse wheel 44 may rotate at the same speed.

Through the above structure, power may be transferred from the driving motor 27 to the forward wheels 43 and the reverse wheels 44 of the wheel assemblies 40*a* and 40*b*. In this embodiment, the operation of transferring power from the driving motor 27 to the forward wheels 43 and the reverse wheels 44 of the wheel assemblies 40*a* and 40*b* may be performed regardless of an angle of rotation of the wheel housing 41, because the connection shaft CS connecting the base gear assembly to the wheel gear assembly is formed in the inside of the shaft portion 41*a* that is the rotation shaft of the wheel housing 41, as described above.

A one-way clutch C (see FIG. 7) may be disposed between the forward gear FG2 and the forward wheel 43. The one-way clutch C may be configured to cause a rotation force to be transferred to the forward wheel 43 when the forward gear FG2 rotates in one direction, and when the forward gear FG2 rotates in the opposite direction, the one-way clutch C may prevent a rotation force from being transferred to the forward wheel 43.

More specifically, when the forward gear FG2 rotates in the FR direction, as shown in FIG. 7, a rotation force may be transferred to the forward wheel 43 so that the forward wheel 43 rotates in the FR direction, and when the forward gear FG2 rotates in the RR direction that is opposite to the FR direction, no rotation force may be transferred to the forward wheel 43.

When the driving motor 27 is in an off state, the forward wheel 43 may rotate in the FR direction without receiving any load from the forward gear FG by the one-way clutch C. That is, the forward wheel 43 may rotate idly in the FR direction without receiving any load from the forward gear FG by the one-way clutch C. Accordingly, if a user pushes the main frame 10 forward when the driving motor 27 is in an off state, the wheel assembly 40 may rotate so that the forward wheel 43 contacts the floor, and the forward wheel 43 may rotate idly in the FR direction so that the vacuum cleaner 1 may move forward.

The one-way clutch C may include various structures well-known in the related art, and may be disposed between the reverse gear RG3 and the reverse wheel 44.

Figure 8:
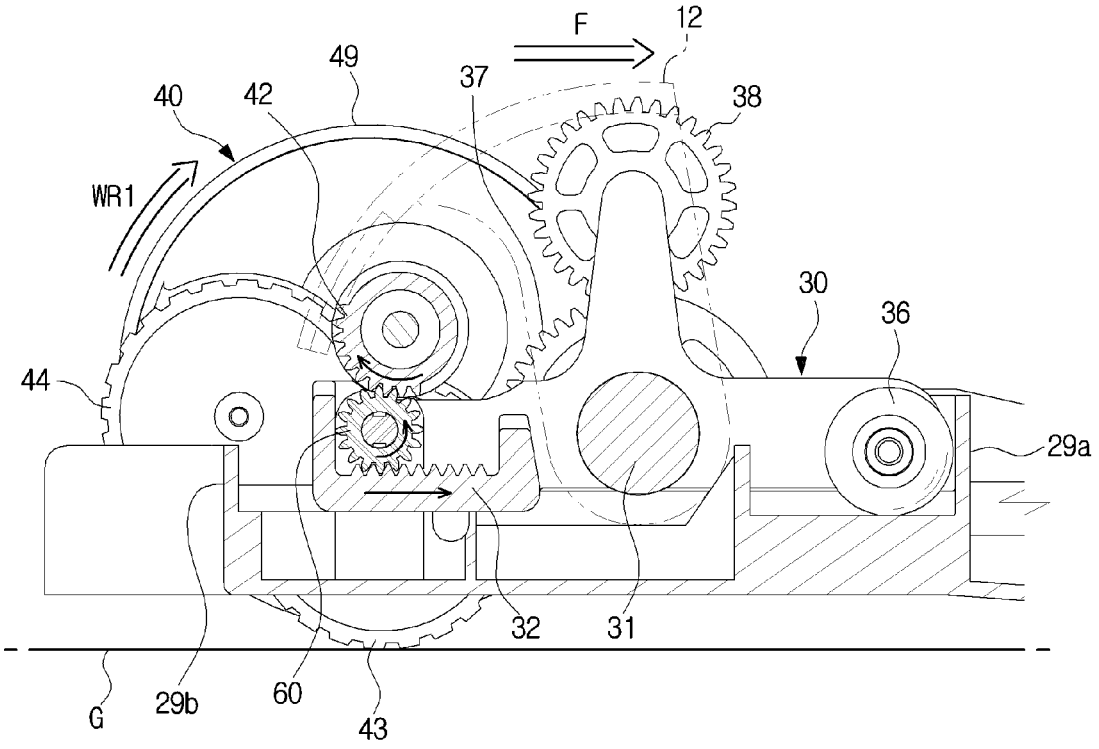
FIGS. 8 and 9 are views for illustrating sliding of a bracket and rotation of a wheel assembly, when a user pushes the main frame of the vacuum cleaner of FIG. 1.
Figure 9:
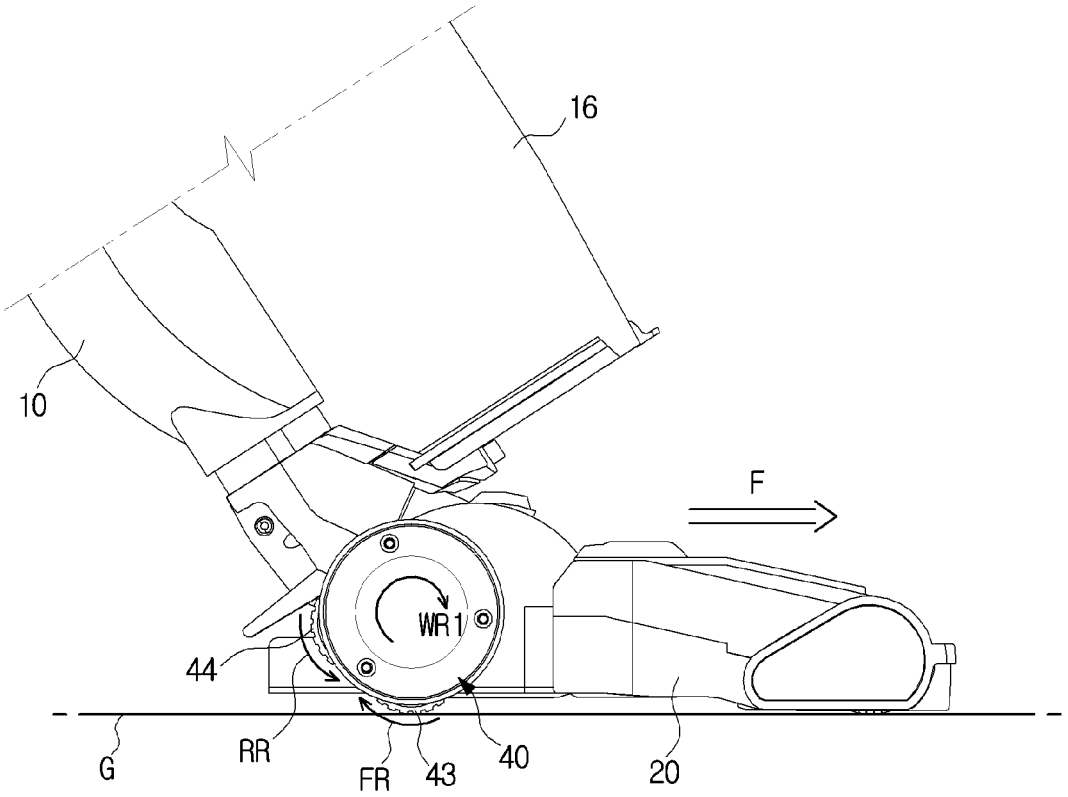
Figure 10:
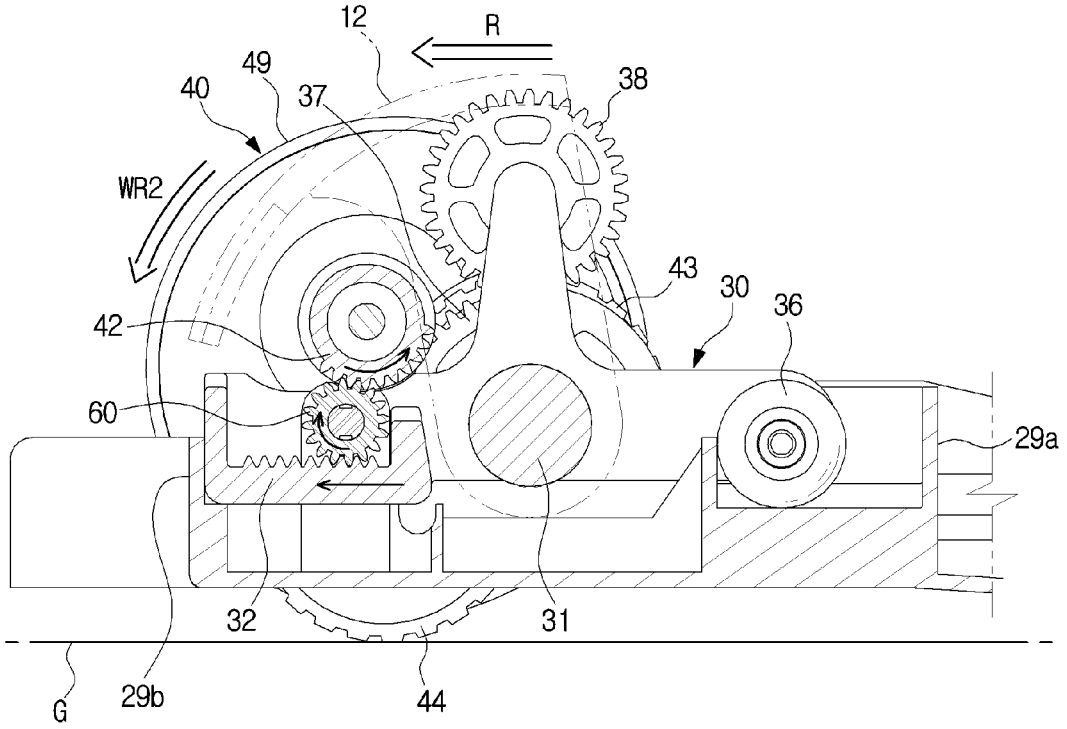
FIGS. 10 and 11 are views for illustrating sliding of the bracket and rotation of the wheel assembly, when a user pulls the main frame of the vacuum cleaner of FIG. 1.
Figure 11:
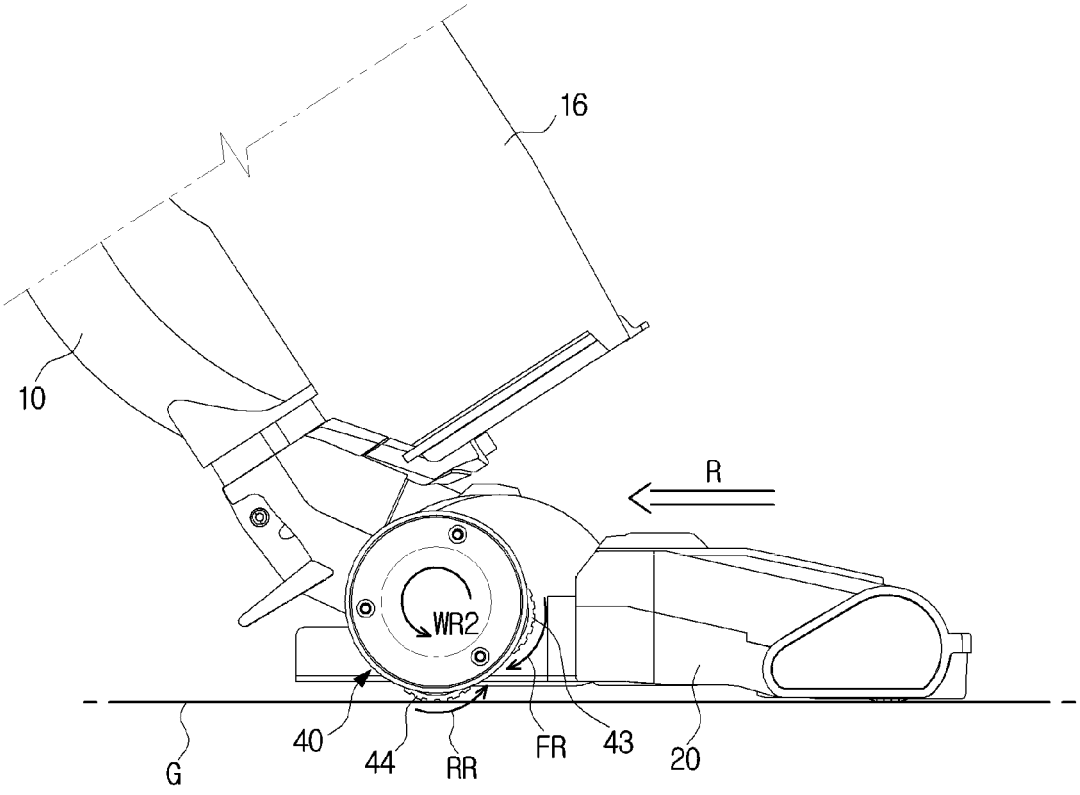

FIGS. 8 and 9 are views for illustrating sliding of a bracket and rotation of a wheel assembly, when a user pushes the main frame of the vacuum cleaner 1 of FIG. 1. FIGS. 10 and 11 are views for illustrating sliding of the bracket and rotation of the wheel assembly, when a user pulls the main frame of the vacuum cleaner 1 of FIG. 1.

Hereinafter, operations of the vacuum cleaner 1 according to an embodiment of the present disclosure will be described with reference to FIGS. 8 to 11.

As shown in FIGS. 8 and 9, when a user grips the handle 17 and pushes the main frame 10, the main frame 10 may slide forward (in an F direction) with respect to the base 20. More specifically, the bracket 30 coupled with the main frame 10 may slide forward (in the F direction) with respect to the base 20.

If the bracket 30 slides forward, the rack gear portion 32 of the bracket 30 may slide forward, and the middle gear 60 engaged with the rack gear portion 32 may rotate.

Since the pinion gear portion 42 of the wheel housing 41 is engaged with the middle gear 60, the wheel housing 41 may rotate in a WR1 direction according to the rotation of the middle gear 60. When the wheel housing 41 rotates, the forward wheel 43 may contact the floor.

The forward wheel 43 may receive power generated by the driving motor 27 through the power transmission mechanism, and rotate in the FR direction. Accordingly, the vacuum cleaner 1 may travel forward.

As shown in FIGS. 10 and 11, when the user grips the handle 17 and pulls the main frame 10 backward, the main frame 10 may slide backward (in an R direction) with respect to the base 20. More specifically, the bracket 30 coupled with the main frame 10 may slide backward (in the R direction) with respect to the base 20.

If the bracket 30 slides backward, the rack gear portion 32 of the bracket 30 may slide backward, and the middle gear 60 engaged with the rack gear portion 32 may rotate.

Since the pinion gear portion 42 of the wheel housing 41 is engaged with the middle gear 60, the wheel housing 41 may rotate in a WR2 direction according to the rotation of the middle gear 60. When the wheel housing 41 rotates, the reverse wheel 44 may contact the floor.

The reverse wheel 44 may receive power generated by the driving motor 27 through the power transmission mechanism, and rotate in the RR direction. Accordingly, the vacuum cleaner 1 may travel backward.

Figure 12:
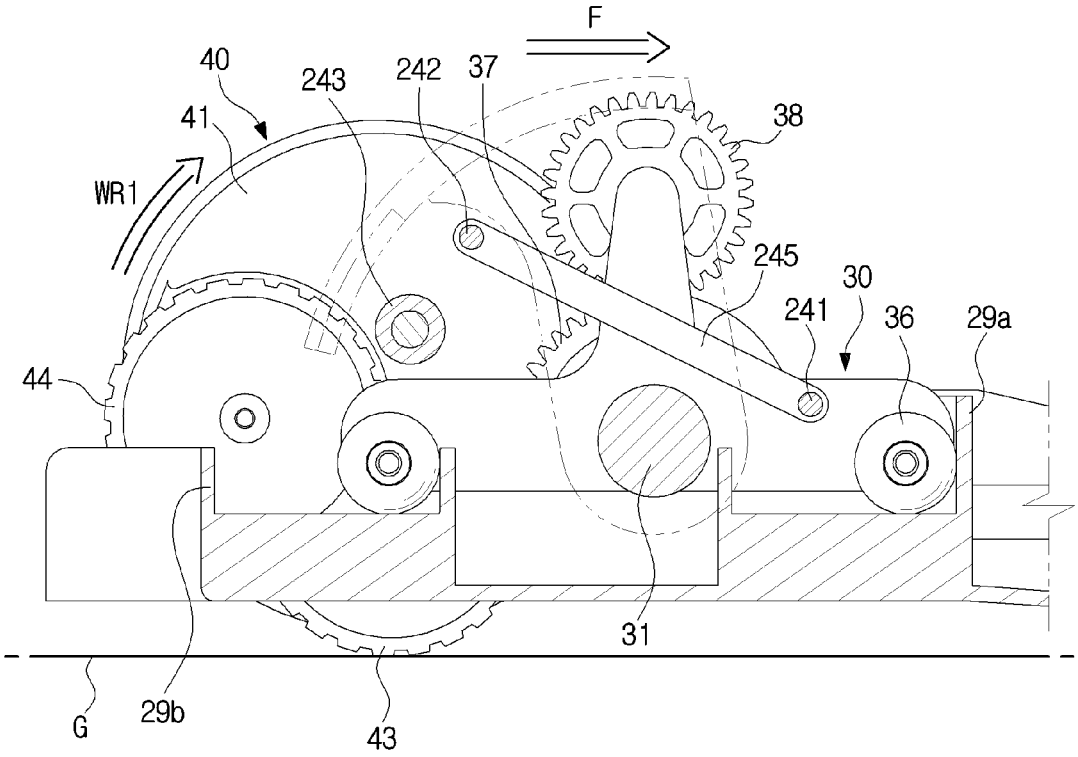
FIGS. 12 and 13 illustrate a slider crank mechanism of a vacuum cleaner according to another embodiment of the present disclosure.
Figure 13:
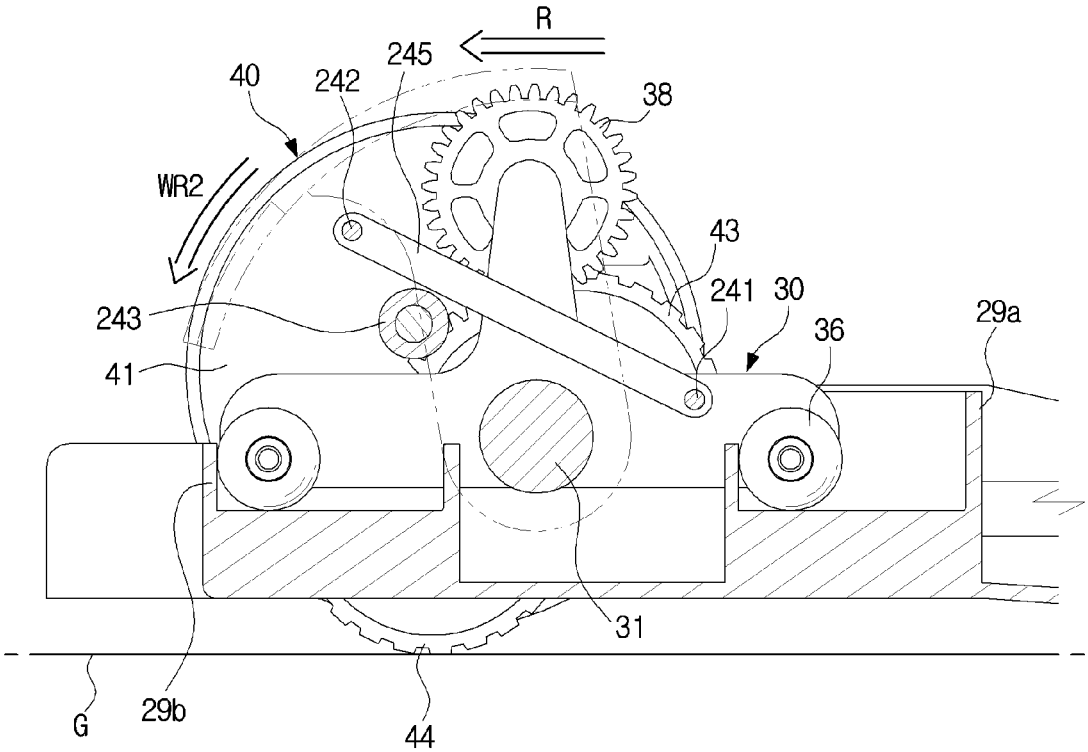

FIGS. 12 and 13 illustrate a slider crank mechanism of a vacuum cleaner according to another embodiment of the present disclosure. Hereinafter, the vacuum cleaner 1 according to the other embodiment of the present disclosure will be described with reference to FIGS. 12 and 13. The same components as in the above-described embodiment will be assigned like reference numerals, and detailed descriptions thereof will be omitted.

In the above-described embodiment, sliding of the main frame 10 may be converted into rotation of the wheel assembly 40 by engagement of the rack gear portion 32 of the bracket 30 with the pinion gear portion 42 of the wheel housing 41. However, various mechanical structures capable of converting sliding into rotation, other than the rack-pinion structure, may be applied to the vacuum cleaner 1.

For example, the vacuum cleaner 1 may include a slider crank mechanism configured to convert sliding of the main frame into rotation of the wheel assembly 40.

The slider crank mechanism may include the bracket 30 configured to be slidable with respect to the base 20, a first joint 241 disposed in the bracket 30, a second joint 242 disposed in the wheel housing 41 of the wheel assembly 40, and a link 245 connecting the first joint 241 to the second joint 242.

One end of the link 245 may be coupled with the first joint 241, wherein the one end of the link 245 may rotate idly on the first joint 241, and the other end of the link 245 may be coupled with the second joint 242, wherein the other end of the link 245 may rotate idly on the second joint 242.

The wheel housing 41 may be coupled with the base 20 in such a way to be rotatable on a rotating shaft 243 with respect to the base 20.

Through the above-described structure, when the main frame 10 moves forward in the F direction, as shown in FIG. 12, the bracket 30 may move forward, and the link 245 may pull the wheel housing 41. Accordingly, the wheel assembly 40 may rotate in the WR1 direction. When the main frame 10 moves backward in the R direction, the bracket 30 may move backward, and the link 245 may push the wheel housing 41. Accordingly, the wheel assembly 40 may rotate in the WR2 direction.

According to the embodiments of the present disclosure, because the wheels of the vacuum cleaner 1 may move forward/backward or turn according to a user's intention, it is possible to improve convenience in operation.

According to the embodiments of the present disclosure, because the wheel driver of the vacuum cleaner 1 may be implemented without adding a sensor or a control circuit, manufacturing costs may be reduced.

Although a few embodiments of the present disclosure have been shown and described, it would be appreciated by those skilled in the art that changes may be made in these embodiments without departing from the principles and spirit of the disclosure, the scope of which is defined in the claims and their equivalents. Although the present disclosure has been described with various embodiments, various changes and modifications may be suggested to one skilled in the art. It is intended that the present disclosure encompass such changes and modifications as fall within the scope of the appended claims.

What is claimed is:

1. A vacuum cleaner comprising:

a base including a suction opening;

a main frame including a dust collecting apparatus configured to remove dust from air sucked through the suction opening;

a wheel assembly including a forward driving wheel and a reverse driving wheel, and rotatably coupled with the base, wherein sliding of the main frame with respect to the base results in one of the wheels moving towards a floor surface and the other moving away from the floor surface; and a bracket coupled with the base and the main frame, wherein the bracket is configured to slide together with the main frame with respect to the base, and wherein the bracket comprises a rack gear portion configured to rotate the wheel assembly.

2. The vacuum cleaner according to claim 1, wherein:

the wheel assembly comprises a wheel housing in which the forward driving wheel and the reverse driving wheel are installed, and the wheel housing comprises a pinion gear portion engaged with the rack gear portion.

3. The vacuum cleaner according to claim 1, further comprising:

a driving motor configured to generate power for driving the forward driving wheel and the reverse driving wheel; and a power transmission mechanism configured to transmit the power from the driving motor to the forward driving wheel and the reverse driving wheel.

4. The vacuum cleaner according to claim 3, wherein the power transmission mechanism comprises a base gear assembly disposed in the base, a wheel gear assembly disposed in a wheel housing, and a connection shaft configured to connect the base gear assembly to the wheel gear assembly.

5. The vacuum cleaner according to claim 4, wherein the wheel gear assembly is configured to rotate on the connection shaft.

6. The vacuum cleaner according to claim 4, wherein the wheel gear assembly comprises a connection gear configured to rotate on the connection shaft, at least one forward gear disposed between the connection gear and the forward driving wheel, and at least one reverse gear disposed between the connection gear and the reverse driving wheel.

7. The vacuum cleaner according to claim 6, further comprising:

a first one-way clutch disposed between the at least one forward gear and the forward driving wheel; and a second one-way clutch disposed between the at least one reverse gear and the reverse driving wheel.

8. The vacuum cleaner according to claim 1, wherein the forward driving wheel and the reverse driving wheel are configured to rotate simultaneously.

9. The vacuum cleaner according to claim 1, wherein the forward driving wheel and the reverse driving wheel are configured to rotate in opposite directions.

10. The vacuum cleaner according to claim 1, wherein the forward driving wheel and the reverse driving wheel are configured to rotate at the same speed.

11. The vacuum cleaner according to claim 1, wherein the wheel assembly comprises an idle wheel configured to contact the floor surface when neither of the forward driving wheel and the reverse driving wheel contacts the floor surface.

12. A vacuum cleaner comprising:

a base including a suction opening;

a main frame including a dust collecting apparatus configured to remove dust from air sucked through the suction opening;

a bracket coupled with the base and the main frame, wherein the bracket comprises a rack gear portion configured to slide together with the main frame with respect to the base; and a wheel assembly including a wheel housing and a wheel installed in the wheel housing, and rotatably coupled with the base, wherein the wheel housing comprises a pinion gear portion engaged with the rack gear portion, and wherein, based on the main frame and the rack gear portion sliding with respect to the base, the wheel moves toward or away from a floor surface as the wheel assembly rotates.

13. The vacuum cleaner according to claim 12, wherein the wheel assembly comprises a left wheel assembly disposed in a left portion of the base, and a right wheel assembly disposed in a right portion of the base.

14. The vacuum cleaner according to claim 13, further comprising:

a driving motor configured to generate power for driving a wheel of the left wheel assembly and a wheel of the right wheel assembly; and a power transmission mechanism configured to transfer power from the driving motor to the wheel of the left wheel assembly and the wheel of the right wheel assembly.

15. The vacuum cleaner according to claim 14, wherein the power transmission mechanism comprises a differential gear apparatus configured to transfer power to the wheel of the left wheel assembly and the wheel of the right wheel assembly, differentially, according to loads applied to the wheel of the left wheel assembly and the wheel of the right wheel assembly.

16. A vacuum cleaner comprising:

a base including a suction opening;

a main frame including a dust collecting apparatus configured to remove dust from air sucked through the suction opening;

a left wheel assembly and a right wheel assembly each including a forward driving wheel and a reverse driving wheel, and rotatably coupled with left and right portions of the base; and a bracket coupled with the base and the main frame, wherein the bracket is configured to slide together with the main frame with respect to the base and comprises a rack gear portion configured to rotate the left wheel assembly and the right wheel assembly, wherein when the main frame is pushed, the left wheel assembly and the right wheel assembly rotate in a first direction so that the forward driving wheel of the left wheel assembly and the forward driving wheel of the right wheel assembly contact a floor surface, and wherein when the main frame is pulled, the left wheel assembly and the right wheel assembly rotate in a second direction that is opposite to the first direction so that the reverse driving wheel of the left wheel assembly and the reverse driving wheel of the right wheel assembly contact the floor surface.

* * * * *